United States Patent [19]

Theurer

[11] 4,178,237

[45] Dec. 11, 1979

[54] MOBILE APPARATUS FOR RECEIVING AND CONVEYING FERROUS RAIL FASTENING ELEMENTS

[75] Inventor: Josef Theurer, Vienna, Austria

[73] Assignee: Franz Plasser Bahnbaumaschinen-Industriegesellschaft m.b.H., Vienna, Austria

[21] Appl. No.: 898,144

[22] Filed: Apr. 20, 1978

[30] Foreign Application Priority Data

Apr. 22, 1977 [AT] Austria ..... 2861/77

[51] Int. Cl.[2] ..... B03C 1/12

[52] U.S. Cl. ..... 209/215; 104/1 R

[58] Field of Search ..... 209/215, 218, 219, 38, 209/420, 421; 214/353; 171/16; 198/510, 506, 690; 37/104; 104/1 R, 2, 17 R, 279

[56] References Cited

U.S. PATENT DOCUMENTS 3,690,264 9/1972 Plasser et al. ..... 104/17 R 3,709,360 1/1973 Baker ..... 209/218 X 3,731,455 5/1973 Theurer ..... 104/1 R X

FOREIGN PATENT DOCUMENTS 1387729 12/1964 France ..... 209/421

*Primary Examiner*—Ralph J. Hill

*Attorney, Agent, or Firm*—Kurt Kelman

[57] ABSTRACT

A mobile apparatus for receiving and conveying ferrous rail fastening elements comprises a carriage driven along a track, a vertically adjustable carrier frame with rollers supporting one of the carrier frame ends for movement along the track, the other carrier frame end being supported on the carriage, magnetic drums mounted on the end carrier frame end and driven for rotation about an axis extending transversely to the track and associated with at least one track rail laterally thereof at both sides of the rail, and a conveyor band arrangement mounted on the carrier frame, the conveyor band arrangement having a receiving end associated with the magnetic drums rearward thereof in the operating direction of the carriage.

8 Claims, 3 Drawing Figures

MOBILE APPARATUS FOR RECEIVING AND CONVEYING FERROUS RAIL FASTENING ELEMENTS

The present invention relates to a mobile apparatus for receiving and conveying ferrous rail fastening elements disposed on the surface of a ballast bed on which two rails of a track rest.

U.S. Pat. No. 3,690,264, dated Sept. 12, 1972, discloses a mobile track working apparatus for use in track renewal operation, wherein previously disassembled rail fastening elements, such as bolts, spikes, tie plates, clamps and the like, may be picked up by magnetic drums or slides guided along the surface of the ballast bed, and the received rail fastening elements may be transferred from the magnetic drums or slides to an endless conveyor band which conveys them to a storage bin on a carriage mounted for mobility in an operating direction on two rails of a track resting on the ballast bed. While this apparatus is useful for its purpose, the surfaces of the magnetic drums or slides in contact with the ballast bed as they are guided along its surface are subject to considerable wear and deformations, due to projecting ballast pieces or bulky fastening elements According to U.S. Pat. No. 3,731,455, dated May 8, 1973, loose rail fastening elements may be picked up by magnetic conveyor means spaced fixedly from the ballast bed and the received fastening elements are then conveyed to a succession of receptacles on a mobile carriage. The filled receptacles require frequent replacement by empty ones, leading to interruptions in the operation.

It is the primary object of the present invention to provide a mobile apparatus of the indicated type but of improved operating capacity and reliable pick-up of ferrous rail fastening elements of various shapes during a non-stop advancement of the apparatus along the track.

The above and other objects are accomplished in accordance with this invention with a carriage mounted for mobility in an operating direction on two rails of a track resting on the ballast bed, the carriage including a frame, a vertically adjustable carrier frame having two ends, rollers supporting one of the carrier frame ends for movement along the track rails and support means supporting the other carrier frame end on the carriage frame, magnetic drum means mounted on the one carrier frame end and driven for rotation about an axis extending transversely to the track, the magnetic drum means being associated with at least one of the rails and extending laterally therof at both sides of the rail, and a conveyor band arrangement mounted on the carrier frame, the conveyor band arrangement having a receiving end associated with the magnetic drum means rearward thereof in the operation direction.

The carriage may be self-propelled, in which case it may be used not only independently but also in connection with other track working apparatus, particularly in connection with modern track renewal trains which rapidly renew tracks. Existing railroad carriages may be readily adapted to incorporate the magnetic drums and conveyor band arrangement of the invention, the magnetic drums and conveyor band arrangement forming a single structural unit with the vertically adjustable carrier frame, which brings about not only weight and cost economies but also facilitates assembly operations.

Since the carrier frame supporting the magnetic drum means and the conveyor band arrangement associated therewith is supported on the track rails by rollers, the magnetic drum means always maintains a predetermined vertical position in relation to the track plane and thus substantially the same distance from the surface of the ballast bed, thereby assuring reliable pick-up of all the ferrous fastening elements disposed on the ballast bed surface, regardless of their size and shape, if the vertical position of the magnetic drum means is suitably selected. Because, furthermore, the magnetic drum means is out of contact with the surface of the ballast bed and of the ties so that no fastening element, however disposed, may be jammed therebetween, the relatively thin walls or skins of the magnetic drums are not subjected to damage and repair work required by rapid wear is substantially reduced. This operating reliability and high capacity makes the apparatus of the present invention particularly useful in combination with track renewal trains whose operating speed depends on the reliability of all the track working apparatus incorporated into the train.

The operating reliability of the apparatus is further enhanced by the fact that the magnetic drum means has a rotating drive which has the advantage over freely rotatable rolls that it provides uniform rotation of the magnetic drums without slipping and makes it possible to coordinate the rotational speed of the drums with the forward speed of the carriage and with the nature and average amount of the ferrous fastening elements to be picked up.

The above and other objects, advantages and features of this invention will become more apparent from the following detailed description of a now preferred embodiment thereof, taken in conjunction with the accompanying schematic drawing wherein FIG. 1 is a side elevational view of the mobile apparatus of the invention;

Figure 1:
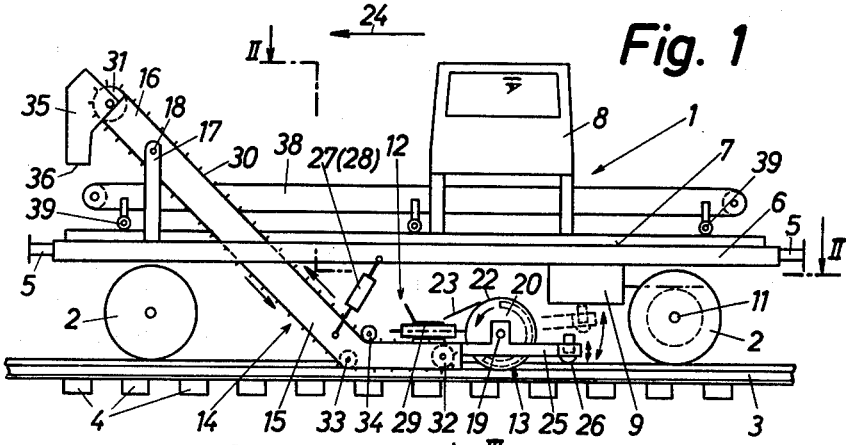

Referring now to the drawing, the mobile apparatus for receiving and conveying ferrous rail fastening elements 40, 41, 42, 43 disposed on the surface of a ballast bed and the ties comprises carriage 1 mounted on undercarriages 2 for mobility in an operating direction indicated by arrow 24 on two rails 3 of a track having ties 4 resting on the ballast bed. Carriage 1 has a frame 6 defining flatbed 7 and couplings 5 are mounted at respective ends of carriage frame 6 to enable the carriage to be incorporated into a train, if desired. Operator's cab 8 is mounted centrally on the flatbed and incorporates a control panel from which all operations of the apparatus may be controlled. In the illustrated embodiments, the carriage is self-contained and self-propelled, for which purpose frame 6 carries on its underside a drive and energy source 9 connected to gear box 10 on rear axle 11 to provide a drive for the carriage, the energy source also including an hydraulic pressure fluid tank and an electric power generator to supply power to various operating parts.

It would be possible, of course, to couple carriage 1 to another car pulling or pushing the carriage along the track and carrying the required power plant for the operation of the various parts of the apparatus.

The apparatus for receiving and conveying ferrous rail fastening elements is designated generally by the numeral 12 and is designed to pick up such rail fastening elements which have been removed from an old track in the course of a track renewal operation and are temporarily disposed on the surface of the ballast bed and of the ties. Apparatus 12 is comprised essentially of vertically adjustable carrier frame 15, magnetic drum means 13 mounted on the carrier frame and conveyor band arrangement 14 mounted on the carrier frame. The carrier frame has two ends, rollers 26 supporting one carrier frame end 25 for movement along track rails 3 and support means 17 constituted by uprights supporting the other carrier frame end 16 on the carriage frame.

In the preferred embodiment illustrated herein, pivot means 18 extending transversely to the track and parallel to the track plane mounts carrier frame 15 on carriage frame 6, and verical adjustment drive means constituted by lifting device 27 consisting of two hydraulic drives 28 links carrier frame 15 to carriage frame 6 for pivoting the carrier frame about pivot means 18. This structurally very simple arrangement makes it possible to lower apparatus 12 rapidly into its working position at the track renewal site from its raised position in which it is normally held during travel of the carriage along the track from one working site to another. It also makes it possible to raise the apparatus swiftly and momentarily to avoid any obstacles, for instance in the region of switches or crossings. Since carriage 1 requires substantially only support 17, 18 and lifting device 27, any railroad carriage may be readily adapted for support of apparatus 12.

As shown by a double-headed arrow, rollers 26 are vertically adjustable on carrier frame 15 for vertically adjusting magnetic drum means 13 mounted on the one carrier frame end 25 in relation to the surface of the ballast bed. This vertical adjustability makes it possible accurately to adjust the distance between the magnetic drum pick-up means and the ballast bed surface so as to assure reliable pick-up of the ferrous rail fastening elements, regardless of the particular height of the rails. The same result may be obtained by mounting rollers 26 readily replaceably on the carrier frame so that rollers of different diameters may be used selectively for the vertical adjustment of carrier frame end 25.

The preferred magnetic drum means 13 illustrated herein is comprised of a plurality of magnetic drums, for instance four drums, aligned along an axis of rotation extending transversely to the track. The magnetic drum means is associated with at least one rail 3 and extends laterally thereof at both sides of the rail, the illustrated embodiment having a pair of drums 20 associated with each rail, one drum of each pair extending laterally from a respective side of the associated rail. In this way, the two outer magnetic drums sweep over the ballast bed regions extending alongside of the rails while the two inner magnetic drums sweep over the ballast bed region between the rails.

Rotary driving axle 19 supports transversely aligned magnetic drums 20 for rotation in a direction indicated by arrows, the driving axle constituting a part of a drive arranged to rotate the drums at an adjustable rotary speed. It will be advantageous to adjust the rotary speed of the magnetic drums, preferably automatically, in response to the forward speed of carriage 1. In this manner, the capacity of the magnetic drums and the conveyor arrangement for receiving and conveying rail fastening elements may be suitably adjusted to the carriage speed so as to assure pick-up of all the loose rail fastening elements disposed along the track. If the carriage speed is low, the rotary speed of the drums may be correspondingly reduced, which saves unnecessary power for the drum drive and generally increases the efficiency of the operation.

As indicated in broken lines in FIG. 1, the coil core of driven magnetic drums 20 is stationarily mounted inside cylindrical wall 21 of the drums, which is a relatively thin skin, and is arcuately shaped over only a portion of the skin of non-magnetic material, thus leaving upper portion 22 of the non-magnetic drum skin remote from the coil core and remaining non-magnetic when the coil core is energized from energy source 9. This non-magnetic drum skin portion constitutes a discharge zone wherefrom the ferrous rail fastening elements picked up by the rotating drum and held on its magnetized drum skin portion are released in the absence of any magnetic attraction in this zone. Guide sheet 23 is mounted adjacent the discharge zone to guide the released rail fastening elements to the receiving end of conveyor band arrangement 14.

This preferred structure of the magnetic drum means provides important weight and energy savings compared to magnetic drum arrangements wherein solenoids are distributed over the drum wall and rotate with the drum. Since the ferrous rail fastening elements are removed from the drum in the discharge zone by their own weight in the absence of any magnetism in this zone, no means is required for removing the elements from the drum and the elements simply move to the receiving end of the conveyor arrangement by gravity.

Guide sheet 23 is arranged substantially tangentially in relation to cylindrical skin 21 of the magnetic drums and extends transversely over the entire width of magnetic drum means 13, being obliquely downwardly inclined in the operating direction 24.

Figure 2:
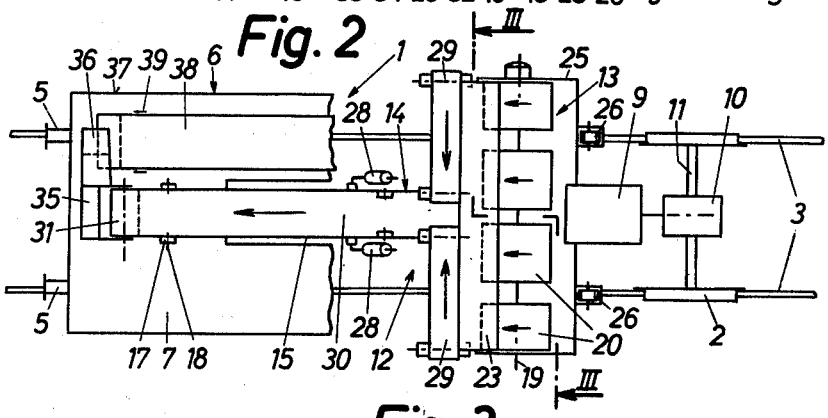
FIG. 2 is a top view of the apparatus, along line II—II of FIG. 1.

Conveyor band arrangement 14 is also mounted on carrier frame 15 and has a receiving end associated with magnetic drum means 13 and rearward thereof in the operating direction. The preferred conveyor band arrangement illustrated herein comprises a pair of endless receiving conveyor bands 29 extending substantially parallel to axis of rotation 19 of the magnetic drum means and constituting the receiving conveyor band arrangement end. As indicated by arrow in FIGS. 2 and 3, receiving conveyor bands 29 are driven in a conveying direction towards a discharge end thereof. Endless main conveyor band 30 has an input end adjacent and underneath the discharge ends of conveyor bands 29 to receive the conveyed fastening elements therefrom, and conveyor band 30 is driven in a conveying direction coincident with operating direction 24 and indicated by arrows in FIGS. 1 and 2 towards a discharge end. Elongated main conveyor band 30 extends in the direction of the track substantially centrally of carriage 1 and rises from the input to the discharge end thereof in operating direction 24, as clearly shown in FIG. 1. Pulleys 31 and 32, respectively mounted at carrier frame ends 16 and 25, support main conveyor band 30 on carrier frame 15, one of the pulleys being a driven pulley. Intermediate the support pulleys, conveyor band 30 is guided by guide rollers 33 and 34. Discharge chute 35 is mounted in the range of pulley 31 at the discharge end of main conveyor band 30 and, as shown in FIG. 2, has a discharge opening 36 offset from the center towards side 37 of carriage 1. Discharge conveyor means 38 has an input end associated with the discharge opening of discharge chute 35. The discharge conveyor means is an endless conveyor band mounted movably on carriage 1, rollers 39 supporting the conveyor band on flatbed 7 for movement therealong in the track direction. The discharge conveyor is so positioned during operation that its input end receives the fastening elements from discharge chute 35 while its discharge end may lead to a storage car coupled to carriage 1 for storing the elements. If desired, a plurality of discharge conveyors may be aligned to transport the picked up rail fastening elements to a plurality of storage cars to assure operation of the apparatus over a lengthy track section.

The illustrated conveyor band arrangement assures rapid and reliable conveyance of all the rail fastening elements picked up by magnetic drum means 13 to the front end of carriage 1 whence they may be transported further by the movable discharge conveyor means and distributed over any number of storage cars.

As is shown for example in U.S. Pat. No. 3,690,264, it may be advantageous to mount on carriage 1 also tool means for assembling and disassembling rail fastening elements so that the carriage may be used not only for the pick-up of loose elements but also for other work in a track renewal operation, i.e. for removing rail fastening elements from an old track as well as for conveying them for assembly of a new track. The number of such tool means may advantageously be coordinated with the pick-up capacity of the magnetic drums and these tool means may be distributed over a number of carriages forming part of a track renewal train. In this manner, the entire working rhythm may be synchronized to obtain maximum operating efficiency and a corresonding increase in the speed of a track renewal operation.

It may also be useful under certain operating conditions to arrange a plurality of magnetic drum means in series in the direction of the track, all of the magnetic drum means preferably feeding a common conveyor band arrangement. Such an arrangement is particularly advantageous in track sections with closely spaced ties and/or multiple-part rail fastenings, which according produce a very great number of rail fastening elements requiring additional pick-up means. Such a magnetic drum means arrangement offers the additional advantage of staggering the magnetic field strength of the serially arranged magnetic drum means, for instance so that the foremost magnetic drum means picks up only relatively light elements, such as screws or nails and the like, while the subsequent magnetic drum means have a higher magnetic force to pick up the heavier element, such as tie plates. In this manner, the smaller elements are sorted out from the larger elements during pick-up.

With the independent drive and energy source carried on carriage 1 and capable of supplying all the necessary power for the operating parts of the apparatus, with the entire operation being controlled by cab 8, the apparatus is totally independent and may be used with maximum efficiency, being capable of being moved rapidly from working site to working site under its own power. With a central cab, a single operator suffices and thus produces additional savings.

Figure 3:
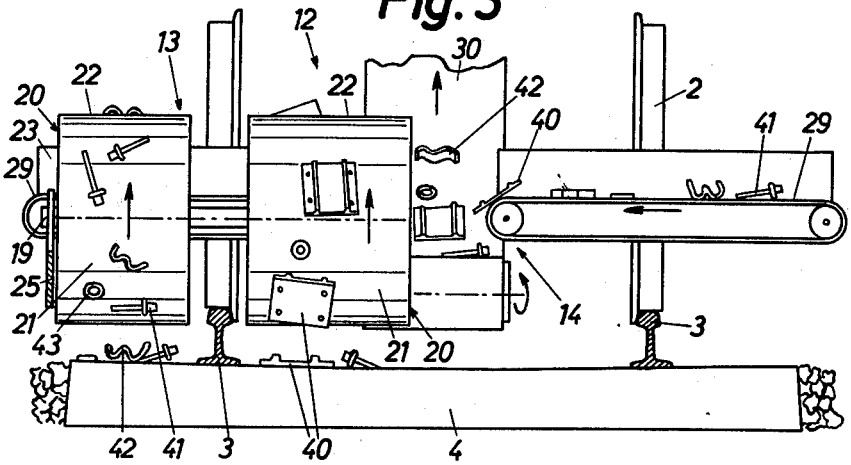
FIG. 3 is an enlarged front view of the apparatus, along line III—III of FIG. 2.

As shown in FIG. 3, the vertical position of magnetic drums 20 is so adjusted during operation that drum skins 21 project slightly below a plane defined by the running surfaces of rails 3, which has been found most efficient for the magnetic pick-up of ferrous rail fastening elements. For this purpose, rollers 26 may be vertically adjustably mounted on carrier frame end 25, or the rollers may be readily replaceable by rollers of different diameters, or the rotary axle 19 for the drums may be vertically adjustably mounted on carrier frame 15. This vertical adjustment holds the magnetic drums at a constant average distance from the surface of the ballast bed and the ties, this distance and the magnetic field force of the drums determining the pick-up capacity, i.e. whether only part or all of the rail fastening elements of various weights, such as tie plates 40, tie bolts 41, clamps 42 and rings 43, will be picked up by magnetic drum means 13.

The above-described apparatus operates in the following manner:

Carriage 1 moves along the track in operating direction 24 either under its own power or as part of a track renewal train, continuously or intermittently, depending on the rhythm of the operation. The magnetic drum means 13 and the conveyor bands of conveyor band arrangement 14 are driven at speeds suitably adjusted to each other and, preferably, to the forward speed of the carriage. Carrier frame 15 is lowered into the illustrated operating position and the coils of the magnetic drum means are energized. As the carriage moves along the track, the drum skin portions surrounding the energized coil core will pick up loose ferrous rail fastening elements disposed on the surface of the ballast bed and the ties, and the rotating drums will convey the magnetically attracted rail fastening elements to their discharge zones 22 whence they will fall onto guide sheet 23 and be conveyed by gravity to receiving conveyor bands 29 which convey the elements to main conveyor band 30 for discharge through chute 35. Discharge conveyor 38 will then transport the rail fastening elements to a storage car coupled to carriage 1. Since the most important portions of apparatus 12 are arranged visibly in front of a large glass pane of cab 8 and glassed openings in the bottom of the cab, the operator has an opportunity to view the entire operation at all times to assure reliable operation.

Apparatus 12 may be used on track sections of different structure and having different rail fastening elements because of the particular construction of the magnetic pick-up means and their accurately adjustable vertical positioning. It may be built into existing carriages of various types used in track working operations.

What is claimed is:

1. A mobile apparatus for receiving and conveying ferrous rail fastening elements disposed on the surface of a ballast bed, which comprises (a) a carriage mounted for mobility in an operating direction on two rails of a track resting on the ballast bed, the carriage including
  (1) a frame,
(b) a vertically adjustable carrier frame having two ends,
  (1) rollers supporting one of the carrier frame ends for movement along the track rails and
  (2) support means supporting the other carrier frame end on the carriage frame,
(c) magnetic drum means mounted on the one carrier frame end, the magnetic drum means being associated with at least one of the rails and extending laterally thereof at both sides of the rail,
  (1) the magnetic drum means including a drive for rotation of the drum means about an axis extending transversely to the track and,
(d) a conveyor band arrangement mounted on the carrier frame, the conveyor band arrangement having a receiving end associated with the magnetic drum means and rearward thereof in the operating direction.

2. The mobile apparatus of claim 1, further comprising pivot means extending transversely to the track and parallel to the track plane for mounting the carrier frame on the carriage frame, and a vertical adjustment drive means linking the carrier frame to the carriage frame for pivoting the carrier frame about the pivot means.

3. The mobile apparatus of claim 1 or 2, wherein the rollers are vertically adjustable on the carrier frame for vertically adjusting the magnetic drum means mounted on the one carrier frame end in relation to the surface of the ballast bed.

4. The mobile apparatus of claim 1 or 2, wherein the magnetic drum means is comprised of a plurality of magnetic drums aligned along the said axis, each magnetic drum comprising a coil core surrounded by a skin of non-magnetic, magnetizable sheet material, an upper portion of the non-magnetic drum skin being remote from the coil core and remaining non-magnetic when the coil core is energized, the non-magnetic upper portion being adjacent the receiving end of the conveyor band arrangement.

5. The mobile apparatus of claim 4, wherein the conveyor band arrangement comprises an endless receiving conveyor band extending substantially parallel to said axis and constituting the receiving conveyor band arrangement end, the receiving conveyor band being driven in a conveying direction towards a discharge end thereof, and an endless main conveyor band having an input end adjacent the discharge end of the receiving conveyor band and being driven in a conveying direction towards a discharge end, the main conveyor band extending in the direction of the track and rising from the input to the discharge end thereof in the operating direction.

6. The mobile apparatus of claim 5, further comprising a discharge chute associated with the discharge end of the main conveyor band.

7. The mobile apparatus of claim 6, further comprising a discharge conveyor means having an input end associated with the discharge chute, the discharge conveyor means being mounted movably on the carriage.

8. The mobile apparatus of claim 1, further comprising a drive mounted on the carriage for moving the carriage on the track rails, the drive including transmission means for driving a wheeled axle supporting the carriage on the track, an energy source mounted on the carriage for powering the carriage drive, the rotation of the magnetic drum means and moving conveyor bands of the conveyor band arrangement, and a central operator's cab on the carriage for controlling the carriage drive, the magnetic drum means rotation and the conveyor band movements.

* * * * *